US009498816B2

(12) United States Patent
Legg

(10) Patent No.: US 9,498,816 B2
(45) Date of Patent: Nov. 22, 2016

(54) WIRE TWISTING PLIERS

(71) Applicant: Stride Tool, Inc., Glenwillow, OH (US)

(72) Inventor: Larry Kenneth Legg, Perry, OH (US)

(73) Assignee: Stride Tool, LLC, Glenwillow, OH (US)

( * ) Notice: Subject to any disclaimer, the term of this patent is extended or adjusted under 35 U.S.C. 154(b) by 340 days.

(21) Appl. No.: 14/105,962

(22) Filed: Dec. 13, 2013

(65) Prior Publication Data

US 2014/0165793 A1 Jun. 19, 2014

Related U.S. Application Data

(60) Provisional application No. 61/736,751, filed on Dec. 13, 2012, provisional application No. 61/736,725, filed on Dec. 13, 2012.

(51) Int. Cl.

| | |
|---|---|
| ***B25B 7/14*** | (2006.01) |
| ***B21F 15/04*** | (2006.01) |
| ***B25B 7/22*** | (2006.01) |

(52) U.S. Cl.

CPC ..... *B21F 15/04* (2013.01)

(58) Field of Classification Search

CPC ..... B21F 15/04; B25B 7/14; B25B 7/22

See application file for complete search history.

(56) References Cited

U.S. PATENT DOCUMENTS

| | | | | | |
|---|---|---|---|---|---|
| 1,740,392 | A * | 12/1929 | Donaldson | B21F 15/04 | 140/119 |
| 2,394,807 | A * | 2/1946 | Robinson | B25F 1/00 | 140/119 |
| 2,737,983 | A * | 3/1956 | Pray | B21F 15/04 | 140/118 |
| 3,092,152 | A * | 6/1963 | Neff | B21F 15/04 | 140/119 |
| 4,665,953 | A * | 5/1987 | Randall | B21F 15/04 | 140/118 |
| 4,842,025 | A * | 6/1989 | Box et al. | B21F 15/04 | 140/119 |
| 5,211,209 | A * | 5/1993 | Geibel | B21F 15/04 | 140/118 |
| 5,560,402 | A * | 10/1996 | Bates | B21F 15/04 | 140/118 |
| 9,138,800 | B2 * | 9/2015 | Harrison | B21F 15/04 | 140/1 |
| 2014/0041491 | A1 * | 2/2014 | Ying | B26B 13/16 | 81/319 |

* cited by examiner

*Primary Examiner* — David B Thomas

(74) *Attorney, Agent, or Firm* — Tarolli, Sundheim, Covell & Tummino LLP

(57) ABSTRACT

Pliers (20) include first and second pivotally interconnected plier arms (22, 32) each having a handle (24, 34) and a jaw (26, 36). The plier handles (24, 34) are operable to manipulate the plier jaws (26, 36). The pliers (20) also include a latch mechanism (300) for alternately latching the pliers (20) in a closed condition and releasing the pliers to an open condition in response to successive applications of squeeze to the plier arms (22, 32).

10 Claims, 12 Drawing Sheets

WIRE TWISTING PLIERS

RELATED APPLICATIONS

This application claims the benefit of U.S. Provisional Application Ser. No. 61/736,751, filed Dec. 13, 2012, which is hereby incorporated by reference in its entirety. This application also claims the benefit of U.S. Provisional Application Ser. No. 61/736,725, filed Dec. 13, 2012, which is hereby incorporated by reference in its entirety.

FIELD OF THE INVENTION

The invention relates to a hand tool for twisting safety wires. More particularly, the invention relates to a safety wire twisting hand tool that includes a rotating device adapted for a quick release connection with pliers having different configurations. The invention further relates to safety wire twisting hand tool that includes a latch mechanism for latching the pliers in a closed condition.

BACKGROUND OF THE INVENTION

Wire twisting pliers are used to twist safety wires that are typically used by aircraft mechanics to secure safety wire bolts from accidentally loosening from vibrations, such as those caused by aircraft engines. Safety wire nuts and bolts are used in a number of other applications as well, such as auto racing and industrial equipment. Wire twisting pliers typically include a conventional pair of pliers that is fitted with a locking mechanism and a rotating device. The locking mechanism locks the pliers on the wires that are to be twisted. The rotating device is manually operable to impart rotation of the pliers to thereby twist the wire. Such devices are disclosed in U.S. Pat. Nos. 4,842,025, 5,211,209, and 5,560,402

Wire twisting pliers twist a variety of wire sizes or gages depending on the job requirements. The most common sizes are 0.012", 0.020", 0.025", 0.032", 0.041", and 0.051". As the wire size increases, however, excessive jaw pressure is placed on the wire in order to lock the handles, making the handles difficult to lock and causing damage to the safety wire. This damage to the wire can cause premature failure of the safety wire in its application.

Additional problems can be encountered with the use of common wire twisting pliers. For example, wire twisting pliers are often used on wire bolts that are hard to reach, which causes the user to extend his or her hand/fingers/thumb beyond limitation in an effort to access portions of the tool. Also, during use, wire ends can be left spinning loose, which allows the wires to thrash around during twisting and potentially cause damage to the work piece or injuring the user. Additionally, standard teeth on plier jaws often distort and mar the wire, causing potential failure points in the wire strength. Moreover, safety wires are typically terminated by cutting the twisted wire, folding it over, and then crimping it in a tight loop known as a "pigtail." Pigtails are difficult to accomplish with the bulky nose of existing wire twisters. Furthermore, when cutting the wire prior to twisting, care must be exercised so that the cut-off pieces do not fall into the surrounding machinery.

SUMMARY OF THE INVENTION

The invention relates to pliers that include first and second pivotally interconnected plier arms each having a handle and a jaw. The plier handles are operable to manipulate the plier jaws. The pliers also include a latch mechanism for alternately latching the pliers in a closed condition and releasing the pliers to an open condition in response to successive applications of squeeze to the plier arms.

According to one aspect of the invention, the latch mechanism comprises a cam connected to the first plier arm and a cam receiver connected to the second plier arm. The latch mechanism has a latched condition in which the cam receiver retains the cam to latch the pliers in the closed condition. The latch mechanism has an unlatched condition in which the cam receiver releases the cam to permit placing the pliers in the open condition.

According to another aspect of the invention, the cam is adapted to enter the cam receiver upon closure of the pliers. The cam receiver is adapted to latch onto the cam to place the latch mechanism in the latched condition in response to a predetermined amount of squeeze being applied to the plier arms. The cam receiver is adapted to release the cam to place the latch mechanism in the unlatched condition in response to a subsequent application of the predetermined amount of squeeze.

According to another aspect of the invention, the cam comprises a cylindrical body mounted on the first plier arm for rotation about an axis. The cam comprises a recess on a cylindrical outer surface of the cam. The cam receiver comprises at least one member that enters the recess on the cylindrical surface of the cam. An engagement between the at least one member and portions of the cam defining the recess placing the latch mechanism in the latched condition.

According to another aspect of the invention, the portions of the cam defining the recess comprise an upper cam surface and a lower cam surface. The at least one member engages at least one of the upper cam surface and the lower cam surface to cause the cam to rotate about the axis. The at least one member engages the lower cam surface in the latched condition of the latch mechanism. The at least one member passes through an opening in the lower cam surface when transitioning from the latched condition to the unlatched condition.

According to another aspect of the invention, the pliers include a rotating device that is manually actuatable to rotate the pliers. The plier jaws can comprise a blade for cutting a wire and a wire grasper for grasping the wire cut by the blade. The plier arms are deflectable and resiliently return to their original form in response to the successive applications of squeeze. The resilient return to original form actuates the latch mechanism.

BRIEF DESCRIPTION OF THE DRAWINGS

The foregoing and other features of the invention will become apparent to one skilled in the art to which the invention relates upon consideration of the following description of the invention with reference to the accompanying drawings, in which.

DETAILED DESCRIPTION OF THE INVENTION

Figure 1:
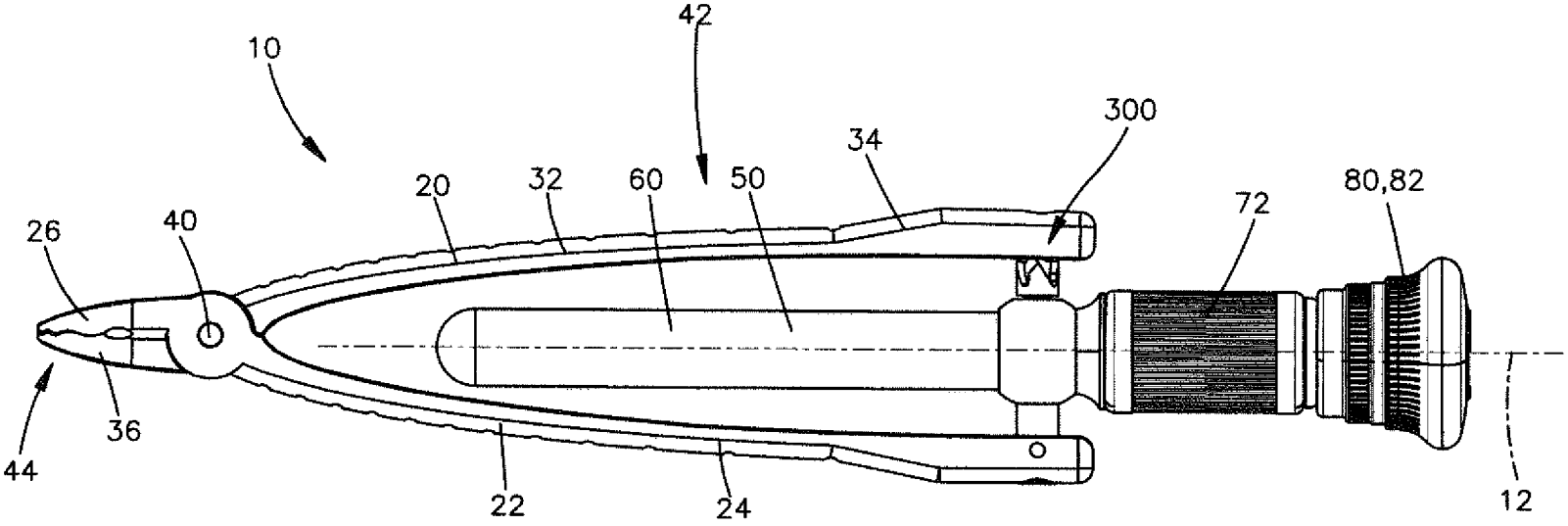
FIG. 1 is a plan view of a wire twisting tool illustrating a first condition of the tool, according to the invention.
Figure 2:
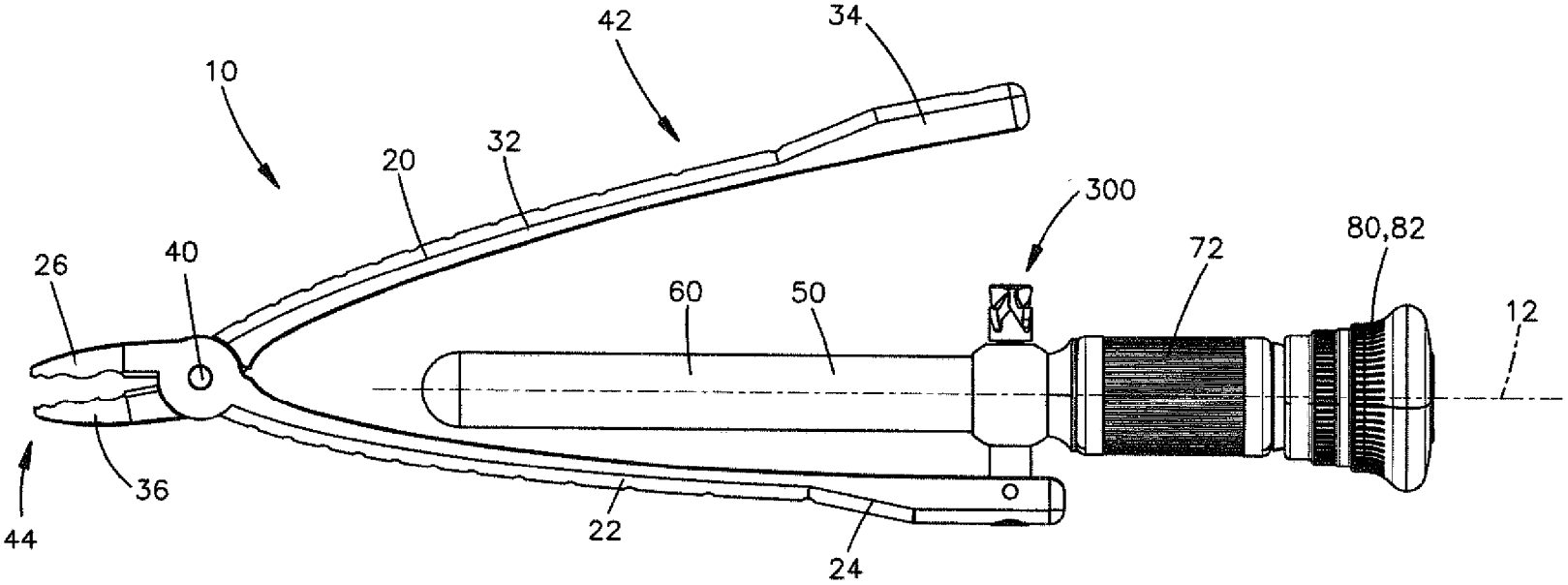
FIG. 2 is a plan view of the wire twisting tool illustrating a second condition of the tool.
Figure 3:
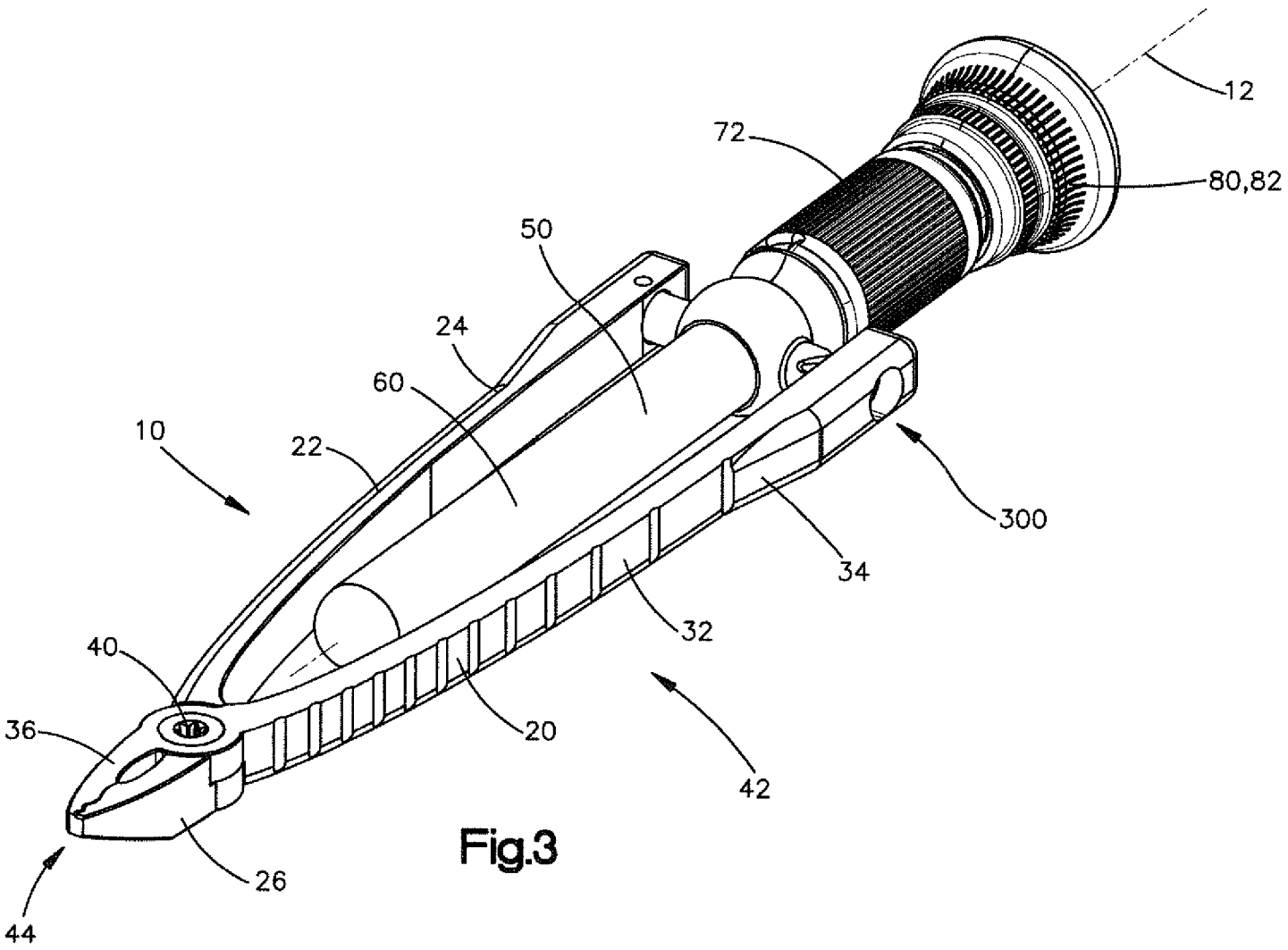
FIGS. 3 and 4 are perspective views of the wire twisting tool.
Figure 4:
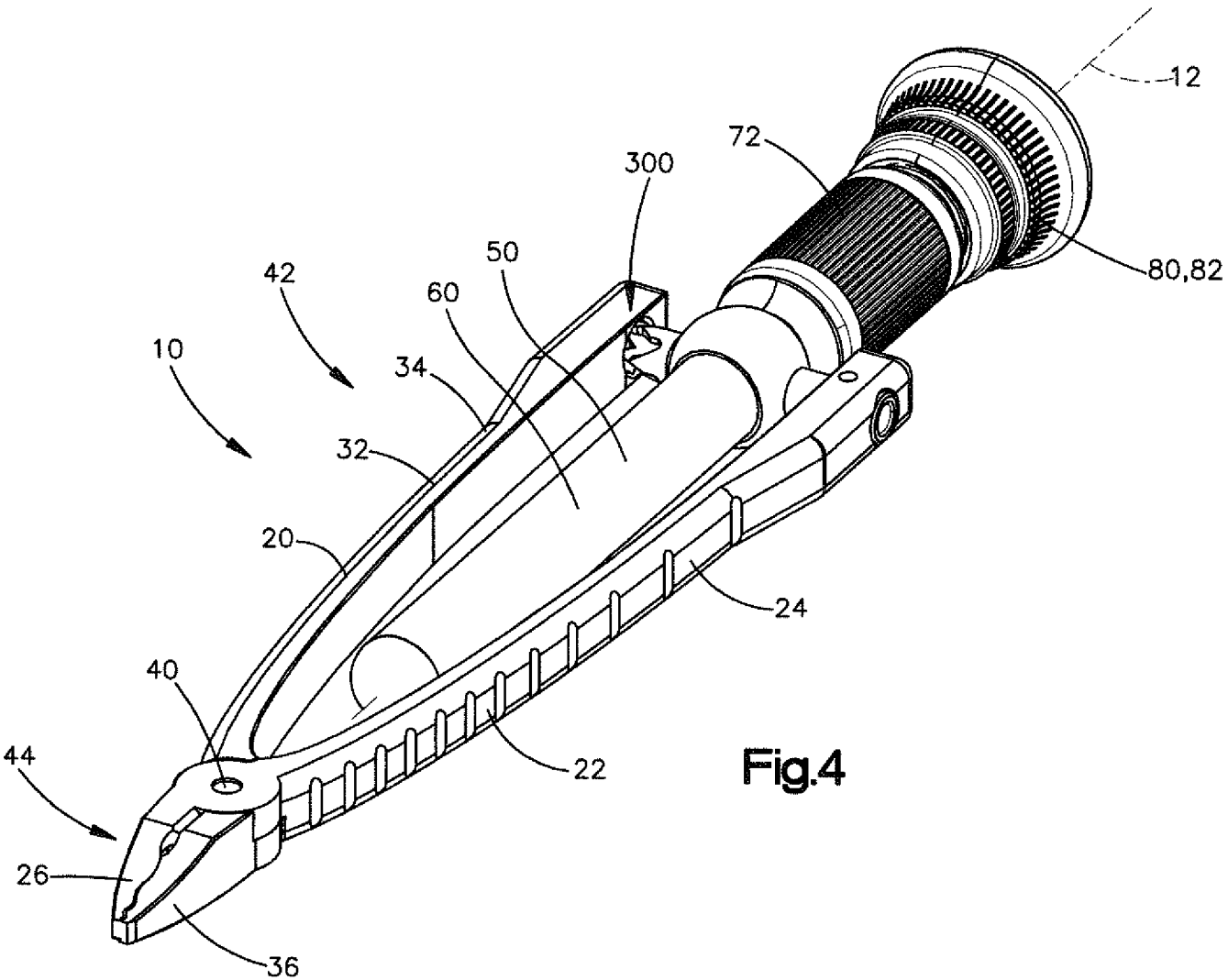

The invention relates to a wire twisting tool for twisting safety wires, such as those commonly used in the aviation industry. Referring to FIGS. 1-4, the wire twisting tool 10 includes pliers 20 and a plier rotating device 50 for imparting rotation of the pliers about an axis 12.

The pliers 20 include a first plier arm 22 and a second plier arm 32. The first plier arm 22 includes a handle portion 24 and a jaw portion 26. The second plier arm 32 includes a handle portion 34 and a jaw portion 36. The handle portions 24 and 34 define a handle 42 of the pliers 20, and the jaw portions 26 and 36 define a head 44 of the pliers. The plier arms 22 and 32 are connected to each other at a pivot joint 40 by means, such as a fastener or press pin. The pliers 20 are operable in a conventional manner to apply a wire gripping force with the plier head 44 via operation of the plier handle 42.

The rotating device 50 includes a housing 60 and a shaft 80 terminated with a knob 82. The shaft 80 is movable along the axis 12 relative to the housing 60 by pulling on the knob 82, which actuates a rotation mechanism in the housing that, in turn, imparts rotation of the housing and the pliers 20 relative to the shaft about the axis 12. The direction of spindle rotation (i.e., the direction of wire twisting) can be selected by the user via rotation selection switch/sleeve 72. To actuate the switch 72, the user rotates the sleeve relative to the housing 60, which switches the direction in which the rotation mechanism rotates the housing 60 in response to the user pulling on the knob 82. For example, rotating the sleeve 72 counterclockwise may result in counterclockwise wire twisting; and rotating the sleeve 72 clockwise may result in clockwise wire twisting.

The rotation mechanism of the rotating device 50 operates to impart rotation of the pliers 20 in a manner that is similar or identical to the manner in which other known rotating devices associated with other wire twisting tools. For example, the rotating device may be configured with a general construction and mode of operation that is similar or identical to the general construction and mode of operation of the wire twisting tools disclosed in U.S. Pat. Nos. 4,842,025, 5,211,209, and 5,560,402, individually or in combination. The disclosures of U.S. Pat. Nos. 4,842,025, 5,211,209, and 5,560,402 are hereby incorporated by reference in their entireties. In operation, the user can lock the plier head 44 onto a wire and pull on the shaft 80 via the knob 82 to effectuate rotation of the pliers 20 to thereby twist the wire.

Figure 5:
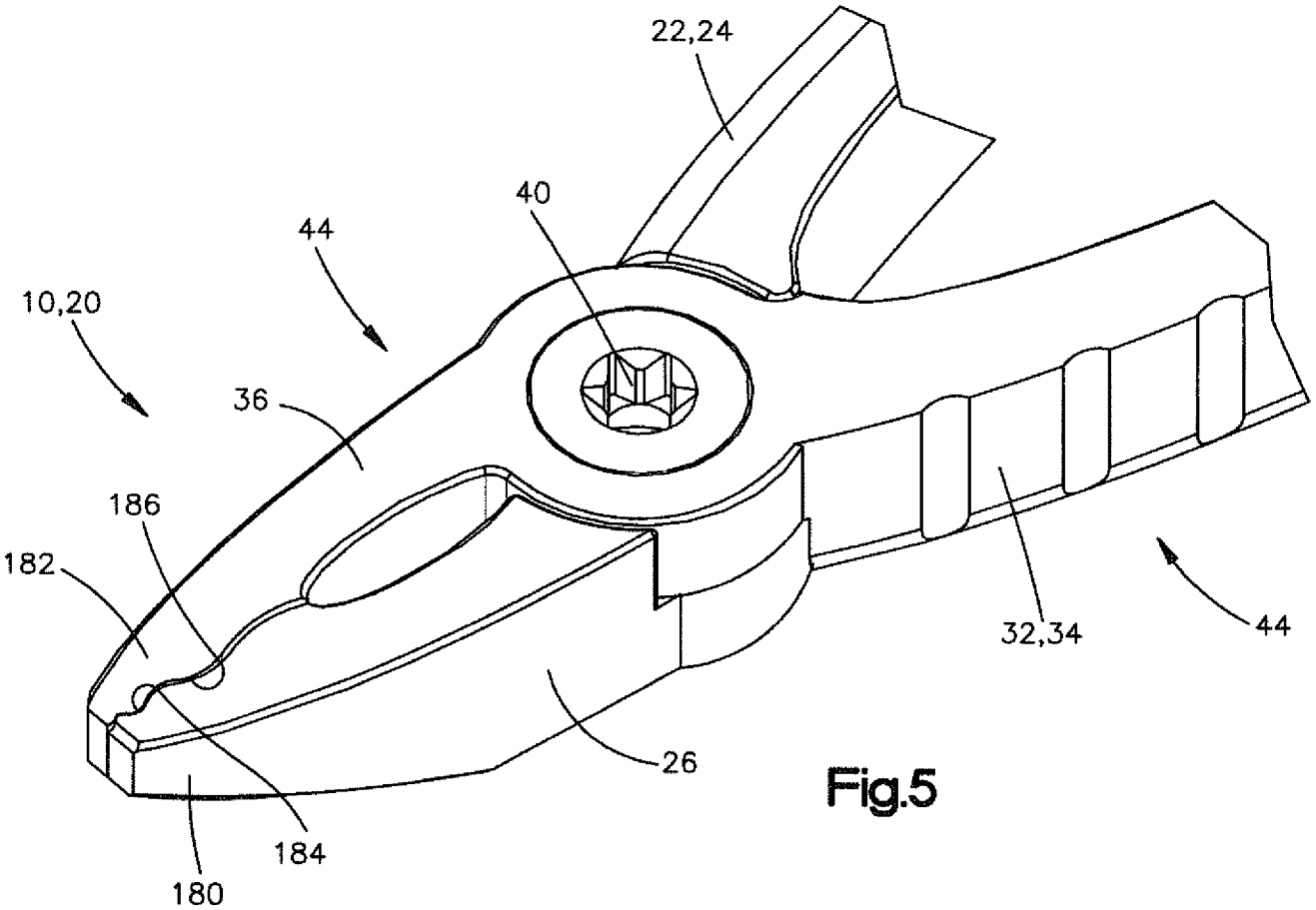
FIG. 5 is a magnified perspective view illustrating a portion of the wire twisting tool.
Figure 6:
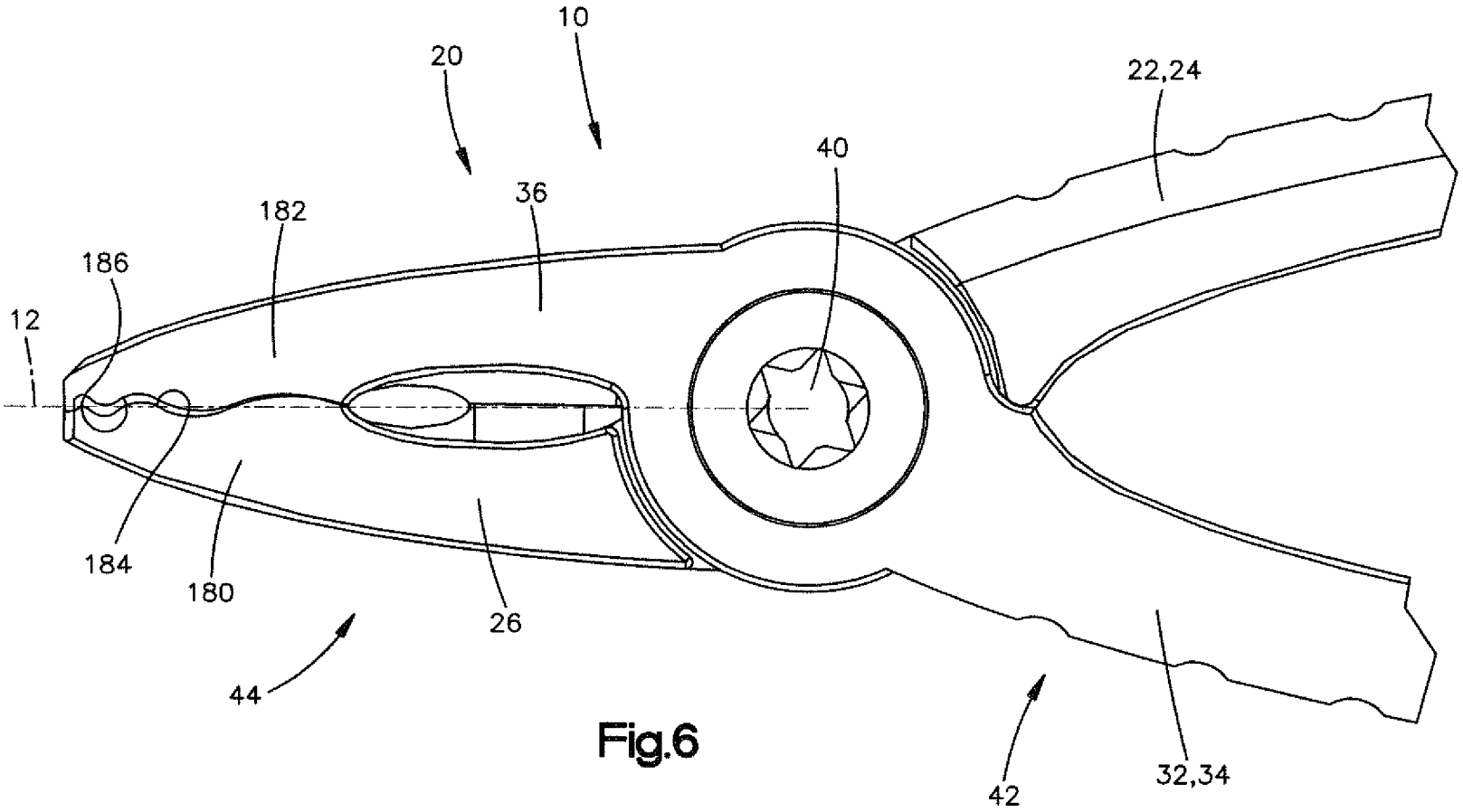
FIG. 6 is a is a magnified plan view illustrating a portion of the wire twisting tool.

As another feature of the invention, the head 44 of the pliers 20 is configured to permit grasping wires while at the same time helping to prevent marring or otherwise damaging the wire. To achieve this, tips 180, 182 of jaws 26, 36, respectively, are configured with waved wire grasping surfaces 184, 186. This is best shown in FIGS. 5 and 6. Utilizing the waves of the surfaces 184, 186 to aid in grasping wires allows for the reduction or elimination of grooves or knurling on the surfaces, which can mar or otherwise damage the wires.

Additionally, the tips 180, 182 have a tapered width configuration (shown best in FIG. 5) such that the terminal end portions of the jaws 26, 36 are narrow and well-suited for improved folding and shaping wire ends to form pigtail terminations. The tips 180, 182 widen beyond the terminal end portions, and the waved surfaces 184, 186 continue through the taper and into the widened portions of the jaws 26, 36. The widened portions of the tips 180, 182 can thus be used primarily for wire gripping, and the narrow portions can be used primarily to terminate wires.

As a feature of the invention, the wire twisting tool 10 includes a latch mechanism 300 that facilitates a simple, quick, and reliable latching of the second plier arm 32 against pivoting movement relative to the first plier arm 22. The latch mechanism 300 is operable to lock the pliers 20 in a closed/clamping condition (FIG. 1). When the handle portions 24, 34 are squeezed to operate the pliers 20 from the open condition (FIG. 2) to the closed condition (FIG. 1), the latch mechanism 300 locks the pliers in the closed condition. When the handle portions 24, 34 are squeezed while the pliers 20 are latched in the closed condition, the latch mechanism 300 is released, thus placing the pliers in the open condition. The latch mechanism 300 thus provides an alternating latch/unlatch operation on successive squeezing of the handle portions 24, 34.

Figure 7:
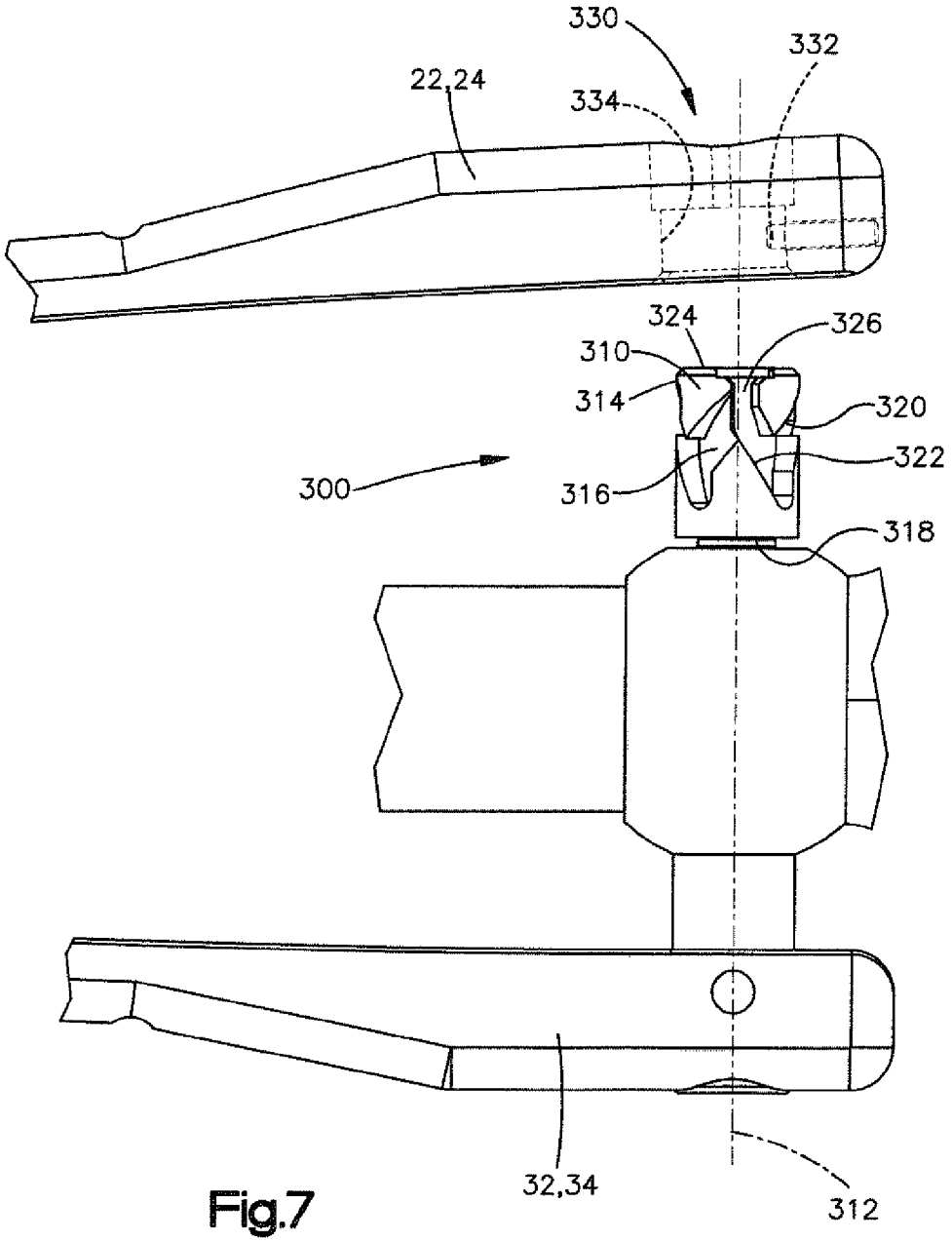
FIG. 7 is a partially schematic plan view illustrating another portion of the wire twisting tool.

Referring to FIG. 7, the latch mechanism 300 includes a cam 310 mounted to the second plier arm 32 and a cam receiver 330 formed in the first plier arm 22. The cam 310 is generally cylindrical and is mounted on the plier arm 22 in a manner, e.g., via fasteners, such that it can rotate freely about an axis 312. The connection between the cam 310 and the plier arm 22 can be such that it can be there is some resistance to rotation so that the cam can be rotated during use, but resists rotation in response to external forces such as normal use of the pliers 20 or the rotating device 50. For example, a leaf spring 318 can bias the cam 310 in a manner that maintains the rotational position of the cam. This spring 318 could deflect when pressure is exerted on the cam 310 in response to a squeezing force applied to the plier arms 22, 32, allowing the cam 310 to rotate about the axis 312 in the manner described below with reference to FIGS. 9A-9F.

The cam receiver 330 includes one or more pins 332 positioned in an opening 334 in the first plier arm 22. The cam 310 moves into the opening 334 when the pliers 20 are placed in the closed condition. When the cam 310 enters the opening 334, it engages the pin 332, which causes the cam 310 to operate in the manner described below with reference to FIGS. 9A-9F.

Figure 8B:
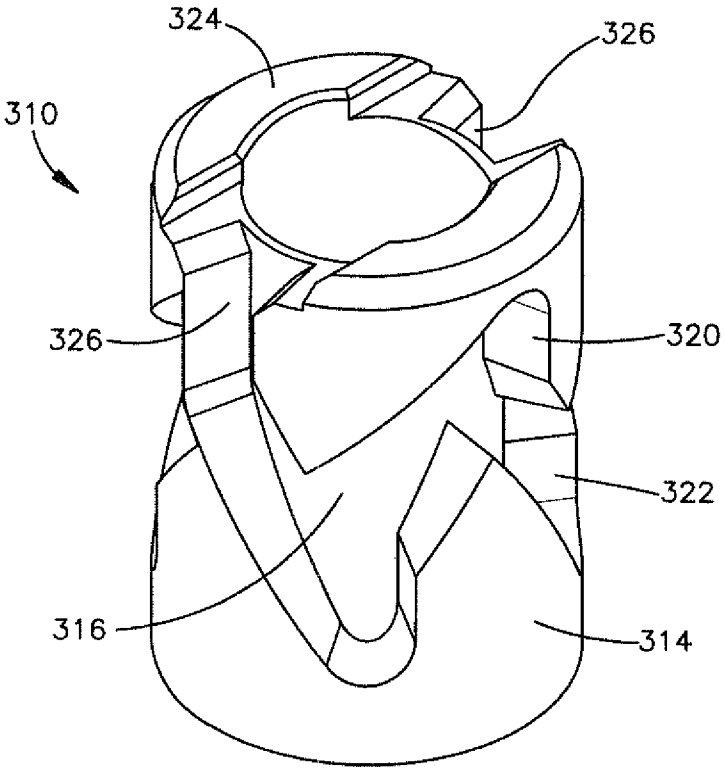
FIGS. 8A-8F illustrate another portion of the wire twisting tool.
Figure 8A:
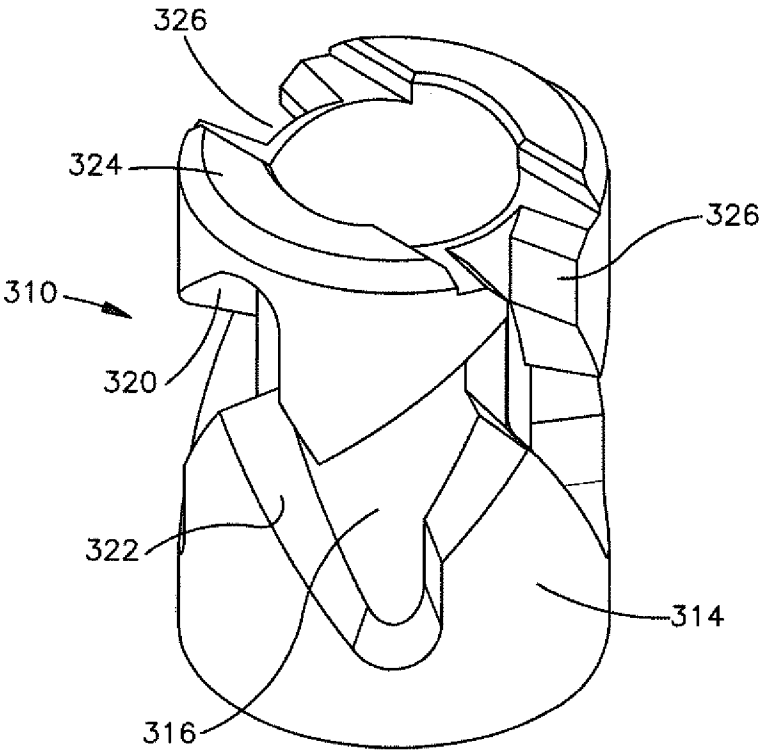
Figure 8C:
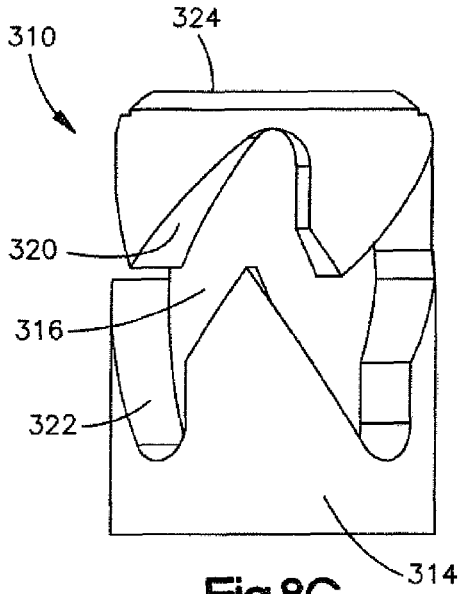
Figure 8D:
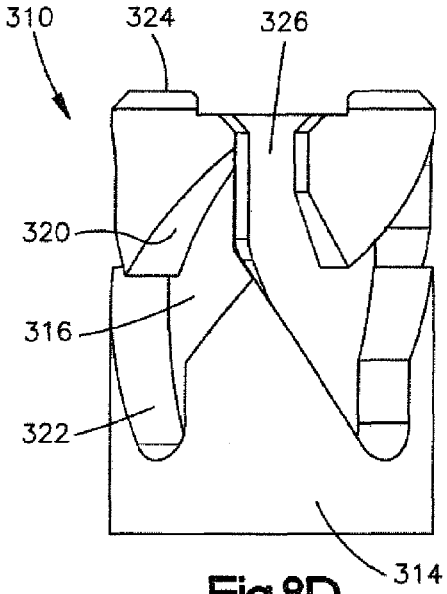
Figure 8E:
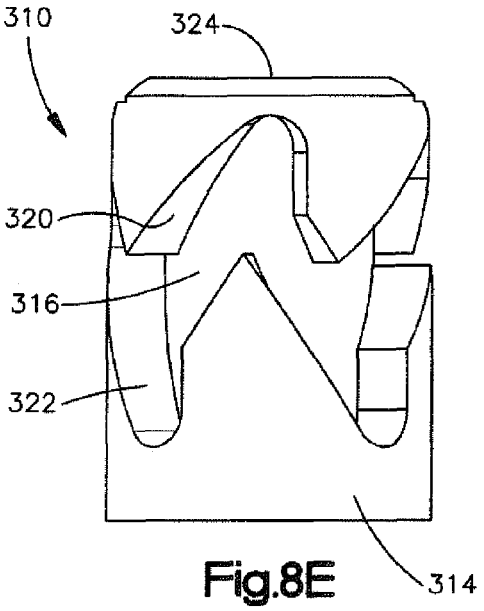
Figure 8F:
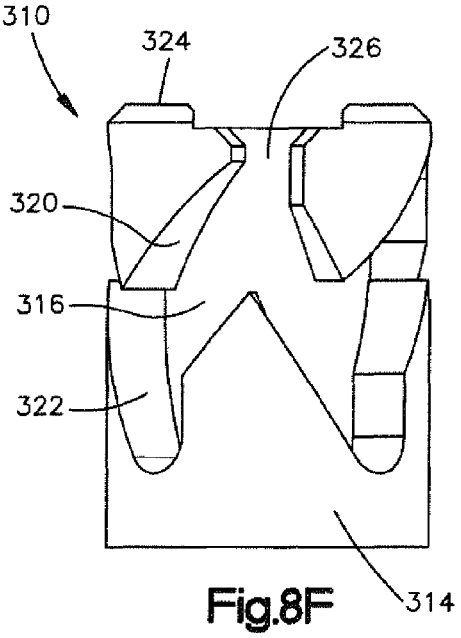

The cam 310 is illustrated in FIGS. 7-8F. The cam 310 has a generally cylindrical outer surface 314. A recess 316 in the surface 314 extends circumferentially around the cam 310. The recess 316 defines a first or upper cam surface 320 and an opposite second or lower cam surface 322. The recess 316 intersects a surface 324 of the cam 310 and thereby forms an opening 326. In this configuration, there are two such openings 326 (see FIGS. 8A and 8B) positioned on radially opposite sides of the cam 310. FIGS. 8C-8F illustrate the side elevation of the cam 310 at 90-degree intervals of rotation and therefore illustrate the entire profile for the upper and lower cam surfaces 320 and 322.

Operation of the latch mechanism 300 is illustrated in FIGS. 9A-9F. In these figures, the cam 310 and the pin 332 of the cam receiver 330 are illustrated schematically. Additionally, for purposes of simplicity in illustration and explanation, the cylindrical cam 310 in FIGS. 9A-9F is illustrated in a generally rectangular form as if the cylindrical cam was cut vertically, "unrolled," and laid flat on a surface. Thus, in FIGS. 9A-9F, opposite ends of the rectangularly illustrated cam 310 meet in its contiguous, cylindrical form.

Figure 9A:
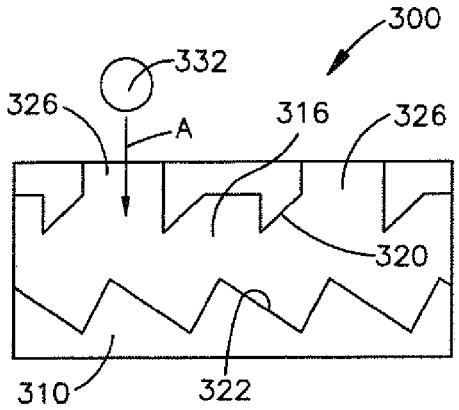
FIGS. 9A-9F are schematic views that illustrate the operation of a portion of the wire twisting tool.

Referring to FIG. 9A, the pin 332 is initially positioned above or outside the cam 310, as is the case when the pliers 20 are in the opened condition (see FIG. 14). As the pliers 20 are moved toward the closed condition, the in moves into the recess 316 of the cam 310 through the opening 326, as indicated generally by the arrow in FIG. 9A. In FIGS. 9A-9F the operation of the latch mechanism 300 is illustrated with a single pin 332. The cam receiver 330 could, however, be fit with two pins that are received in openings 328 on radially opposite sides of the can 310.

Figure 9B:
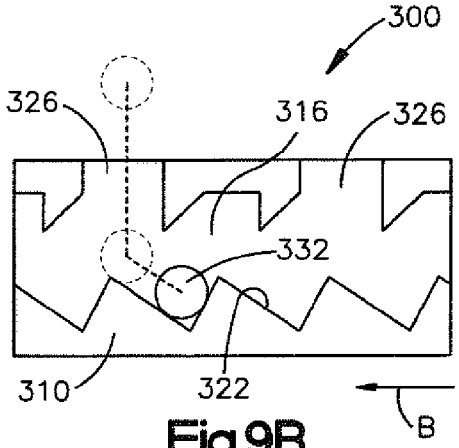

Referring to FIG. 9B, as the plier handles 24, 34 are closed, the pin 332 enters the recess 316 through the opening 326 and moves along a path indicated generally by the dashed lines in FIG. 9B until it engages the lower cam surface 322. Further closure of the handles 24, 34 causes the pin 332 to slide along the inclined portion of the lower cam surface 322. As a result, the cam 310 rotates, as indicated generally by arrow B in FIG. 9B. The pin 332 eventually reaches the pin 332 in the final position illustrated in solid lines. This further closure movement of the handles 24, 34 is facilitated through the deflection of the handles, once the jaws 26, 36 have closed and clamped onto a work piece, such as a wire.

Figure 9C:
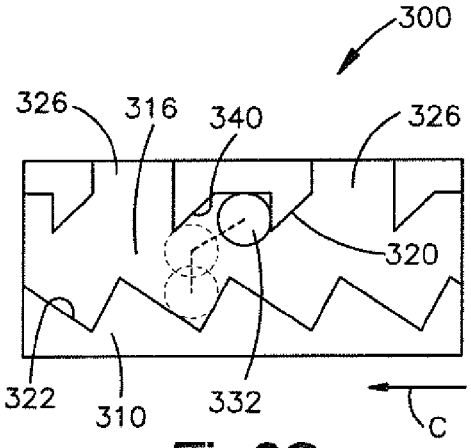

Referring to FIG. 9C, when the closure force is removed from the plier handles 24, 34, the pin 332 can move upward as viewed in FIG. 9C along the path indicated generally by the dashed lines in FIG. 9C. Since the cam 310 had been rotated due to the initial closure (see FIG. 9B), upward movement of the pin 332 results in its engaging the upper cam surface 320. This upward movement can be attributed to the removal of the closure force from the plier handles 24, 34 and their resulting resilient return to original form, having been deflected during closure. This upward movement of the pin 332 against the upper cam surface 320 causes the cam 310 to rotate further, as indicated generally by arrow B in FIG. 9B. This further closure movement of the handles 24, 34 may be facilitated through the deflection of the handles, once the jaws 26, 36 have closed and clamped onto a work piece, such as a wire.

In the condition illustrated in FIG. 9C, the pin is retained in the concave portion 340 of the upper cam surface 320. The latch mechanism 300 is latched and the plier handles 24, 34 are locked in the closed condition (see FIG. 15) and blocked from moving toward the open condition (see FIG. 14).

Figure 9D:
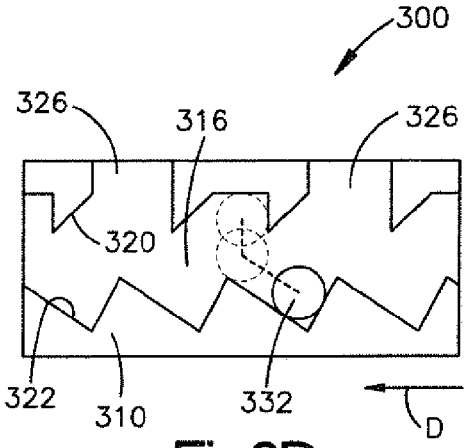

Referring to FIG. 9D, to unlatch the latch mechanism 300 and thereby place the pliers 20 in the open condition, the plier handles 24, 34 are again squeezed, which causes the pin 332 to move along a path indicated generally by the dashed lines in FIG. 9D until it engages the lower cam surface 322. Further closure of the handles 24, 34 causes the cam 310 to rotate as the pin 332 slides along the inclined portion of the lower cam surface 322. The rotation of the cam 310 is indicated generally by arrow D in FIG. 9B. This eventually leaves the pin 332 in the final position illustrated in solid lines. This further closure movement of the handles 24, 34 may be facilitated through the deflection of the handles, e.g., once the jaws 26, 36 have closed and clamped onto a work piece, such as a wire.

Figure 9E:
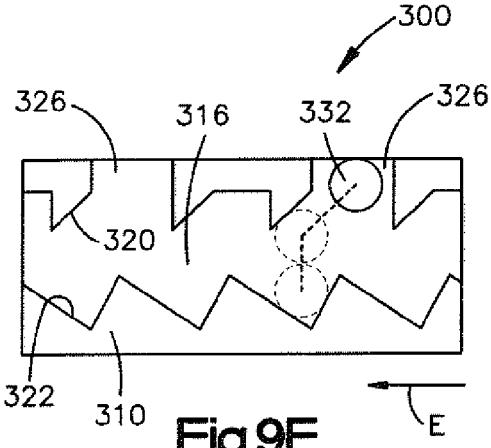

Referring to FIG. 9E, when the closure force is removed from the plier handles 24, 34, the pin 332 can move upward as viewed in FIG. 9E along the path indicated generally by the dashed lines in FIG. 9E. Since the cam 310 had been rotated due to the previous application of handle closure force (see FIG. 9D), upward movement of the pin 332 results in its engaging the upper cam surface 320. This upward movement can be attributed to the removal of the closure force from the plier handles 24, 34 and their resulting resilient return to original form, having been deflected during closure. This upward movement of the pin 332 causes the pin to slide along the inclined portion of the upper cam surface 320. This the cam 310 to rotate further, as indicated generally by arrow E in FIG. 9E. Eventually, the pin 332 reaches the opening 326, as indicated generally in solid lines in FIG. 9E.

Figure 9F:
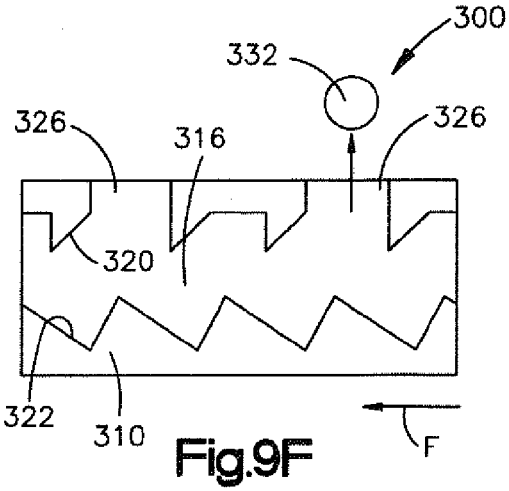

Referring to FIG. 9F, the pin 332 can then exit the cam receiver 330 and the pliers can be placed in the open condition. Additionally, the exit of the pin 332 from the cam 310 has positioned the openings 326 in the cam in a position to receive the pin for a subsequent closure and latching of the pliers 20. The latch mechanism 300 thus facilitates a sequential latched-unlatched operation on sequential application of squeezing/closure force applied to the plier handles 24, 34.

Figure 10:
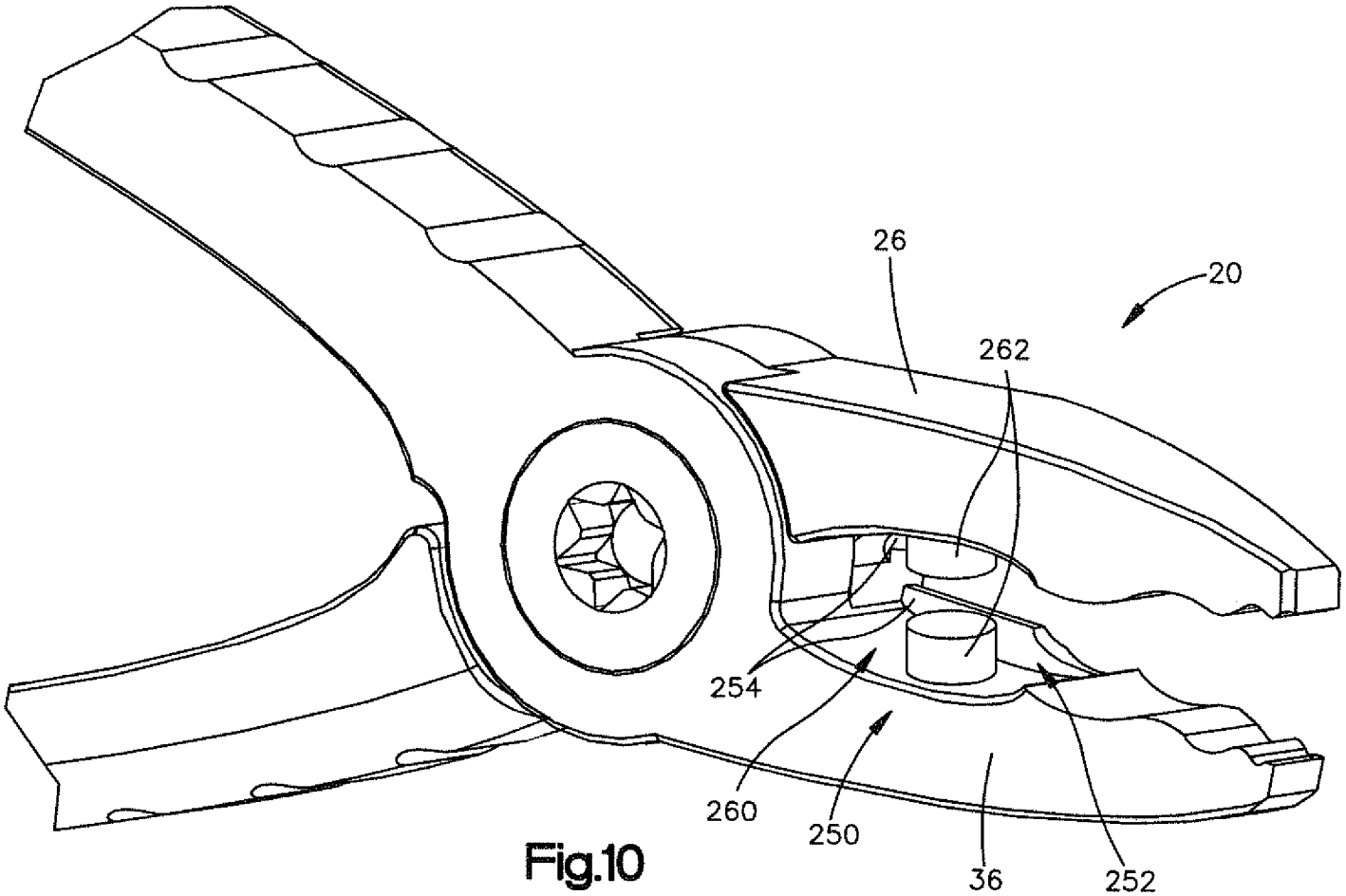
FIGS. 10 and 11 are magnified views illustrating another portion of the wire twisting tool.
Figure 11:
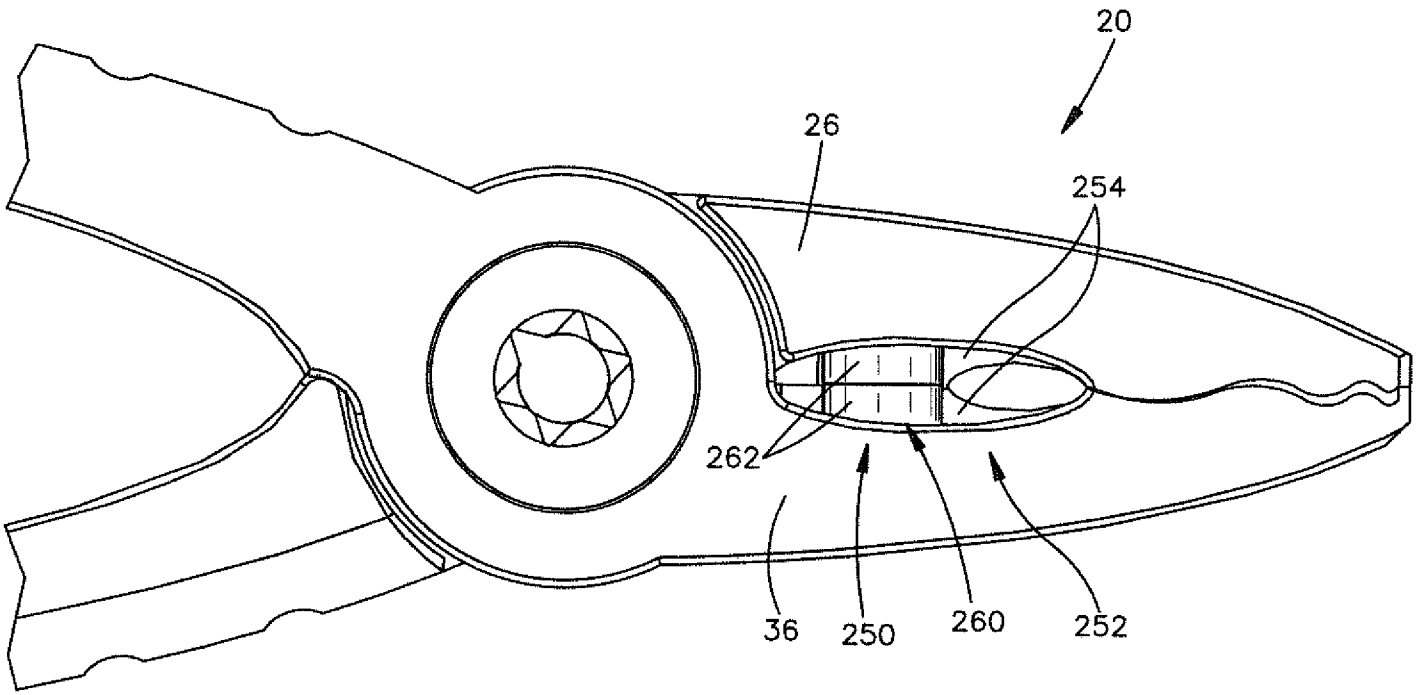

Referring to FIGS. 10-11, as a feature of the invention, the pliers 20 include a wire cutting and grasping mechanism 250 for cutting a wire, e.g., a safety wire twisted onto a safety wire bolt. The wire cutting and grasping mechanism 250 is formed as a portion of the plier jaws 26, 36, and includes a wire cutter 252 and a wire grasper 260. In the illustrated embodiment, the wire cutter 252 includes a pair wire cutting blades 254, one associated with each of the plier jaws 26, 36. In a cutting condition of the pliers 20, the blades 254 engage each other and thereby can cut a wire positioned between the blades.

The wire grasper 260 includes a pair of grasping elements 262, one associated with each of the plier jaws 26, 36. The grasping elements 262 are pads that are constructed of a deformable material, such as a rubber, plastic, or polymeric material. When a wire is positioned between the cutting blades 254, a portion of the wire is also positioned between the grasping elements 262. When the pliers 20 are closed, the cutting blades cut the wire, and the grasping elements 262 clamp onto the wire. The deformable nature of the material used to construct the grasping elements 262 may help facilitate this clamping action. Advantageously, if the user positions a free end of a wire between the grasping elements 262, that cut portion of wire will remain held by the grasping elements after it is cut and separated from the remainder of the wire.

From the above description of the invention, those skilled in the art will perceive improvements, changes and modifications. Such improvements, changes and modifications within the skill of the art are intended to be covered by the appended claims.

Having described the invention, the following is claimed:

1. Pliers comprising:

first and second pivotally interconnected plier arms each having a handle portion and a jaw portion, the jaw portions forming plier jaws and the handle portions forming plier handles operable to manipulate the plier jaws; and a latch mechanism for alternately latching the pliers in a closed condition and releasing the pliers to an open condition in response to successive applications of squeeze to the plier arms.

2. The pliers recited in claim 1, further comprising a rotating device that is manually actuatable to rotate the pliers, the cam receiver comprising a portion of the rotating device.

3. The pliers recited in claim 2, wherein the rotating device comprises a quick-release mechanism for mounting the plier rotating device to the first plier arm so that the pliers rotate with the plier rotating device when actuated, and a latch mechanism for latching onto the second plier arm to maintain a wire gripping force exerted by the jaw portions.

4. The pliers recited in claim 2, wherein the plier rotating device comprises:

a housing;

a spindle rotatable relative to the housing about an axis;

a shaft moveable along the axis relative to the housing to impart rotation of spindle, the quick release mechanism being mounted to the spindle and rotatable with the spindle.

5. Pliers comprising:

first and second pivotally interconnected plier arms each having a handle portion and a jaw portion, the jaw portions forming plier jaws and the handle portions forming plier handles operable to manipulate the plier jaws; and a latch mechanism for alternately latching the pliers in a closed condition and releasing the pliers to an open condition in response to successive applications of squeeze to the plier arms, wherein the latch mechanism comprises a cam connected to the first plier arm and a cam receiver connected to the second plier arm, the latch mechanism having a latched condition in which the cam receiver retains the cam to latch the pliers in the closed condition, the latch mechanism having an unlatched condition in which the cam receiver releases the cam to permit placing the pliers in the open condition.

6. The pliers recited in claim 5, wherein the cam is adapted to enter the cam receiver upon closure of the pliers, the cam receiver being adapted to latch onto the cam to place the latch mechanism in the latched condition in response to a predetermined amount of squeeze being applied to the plier arms, the cam receiver being adapted to release the cam to place the latch mechanism in the unlatched condition in response to a subsequent application of the predetermined amount of squeeze.

7. The pliers recited in claim 5, wherein:

the cam comprises a cylindrical body mounted on the first plier arm for rotation about an axis, the cam comprising a recess on a cylindrical outer surface of the cam; and the cam receiver comprises at least one member that enters the recess on the cylindrical surface of the cam, an engagement between the at least one member and portions of the cam defining the recess placing the latch mechanism in the latched condition.

8. The pliers recited in claim 7, wherein the portions of the cam defining the recess comprise an upper cam surface and a lower cam surface, the at least one member engaging at least one of the upper cam surface and the lower cam surface to cause the cam to rotate about the axis.

9. The pliers recited in claim 7, wherein the portions of the cam defining the recess comprise an upper cam surface and a lower cam surface, the at least one member engaging the lower cam surface in the latched condition of the latch mechanism.

10. The pliers recited in claim 7, wherein the portions of the cam defining the recess comprise an upper cam surface and a lower cam surface, the at least one member passing through an opening in the lower cam surface when transitioning from the latched condition to the unlatched condition.

* * * * *